US006705610B2

(12) United States Patent
Schumann

(10) Patent No.: US 6,705,610 B2
(45) Date of Patent: Mar. 16, 2004

(54) ARRANGEMENT FOR SHEET HOLDER SYSTEMS ON STORAGE DRUMS IN TURNING DEVICES OF SHEET-FED PRINTING MACHINES

(75) Inventor: Frank Schumann, Radebeul (DE)

(73) Assignee: Koenig & Bauer AG, Radebeul (DE)

( * ) Notice: Subject to any disclaimer, the term of this patent is extended or adjusted under 35 U.S.C. 154(b) by 0 days.

(21) Appl. No.: 10/141,513

(22) Filed: May 8, 2002

(65) Prior Publication Data

US 2002/0195770 A1 Dec. 26, 2002

(30) Foreign Application Priority Data

May 8, 2001 (DE) ..... 101 22 215

(51) Int. Cl.[7] ..... B65H 5/02
(52) U.S. Cl. ..... 271/276; 271/277; 271/275
(58) Field of Search ..... 271/276, 277, 271/65, 185, 184, 186, 314; 101/410, 408

(56) References Cited

U.S. PATENT DOCUMENTS 3,829,084 A * 8/1974 Jurny ..... 271/277
3,937,142 A * 2/1976 Cerny et al. ..... 101/409
3,944,218 A * 3/1976 Cerny ..... 271/277
4,024,814 A * 5/1977 Becker ..... 101/410
4,026,209 A * 5/1977 Wirz et al. ..... 101/231
4,204,471 A * 5/1980 Becker ..... 101/410
5,168,809 A * 12/1992 Becker ..... 101/408
5,172,634 A * 12/1992 Iwamoto ..... 101/410

* cited by examiner

*Primary Examiner*—Donald P. Walsh
*Assistant Examiner*—Kaitlin Joerger
(74) *Attorney, Agent, or Firm*—Goodwin Procter, LLC

(57) ABSTRACT

The invention relates to an arrangement of sheet-holding systems at storage drums in turning devices of sheet-fed printing machines.

Figure 1:
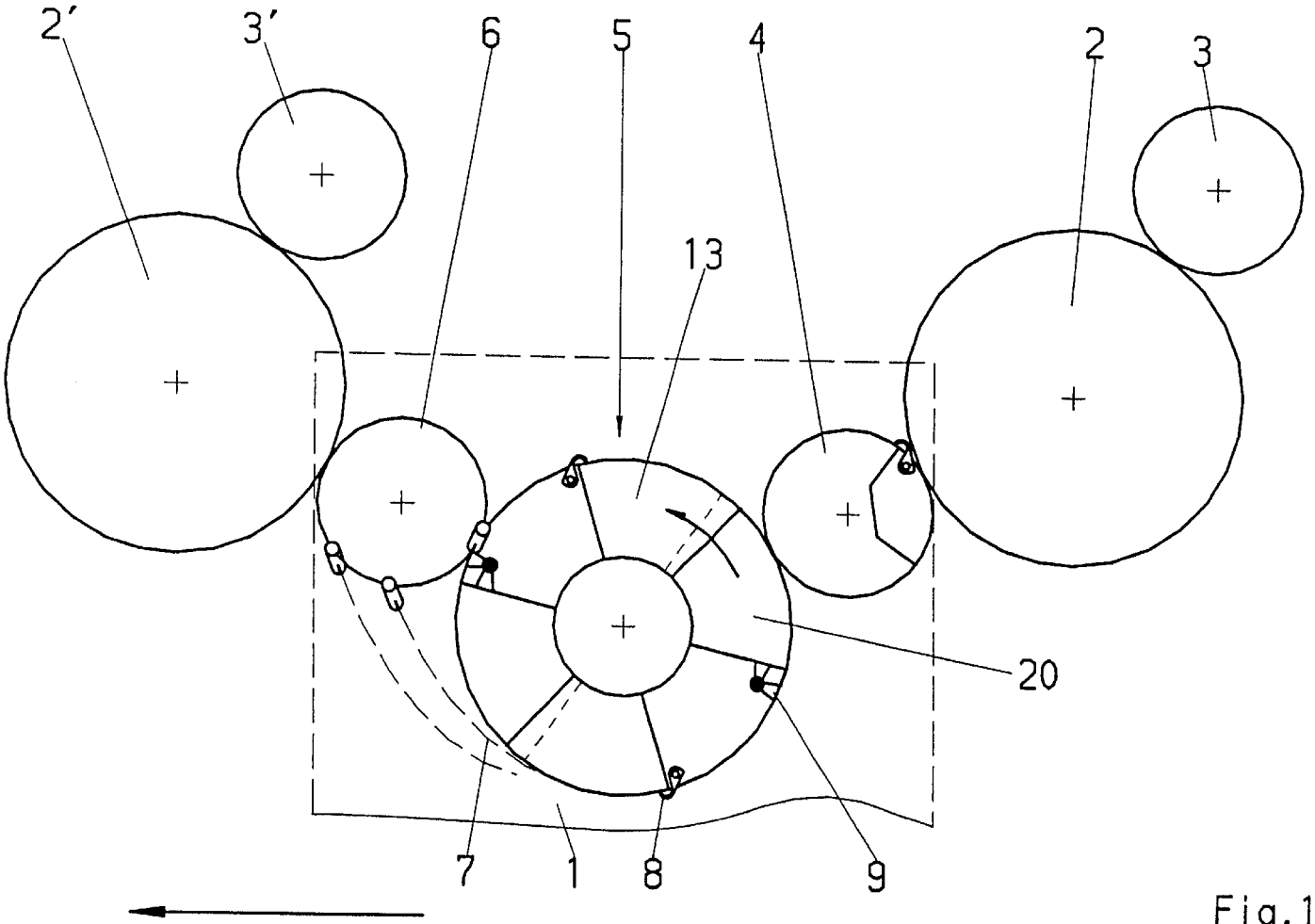

It is an object of the invention to provide an arrangement of sheet-holding systems at storage drums, which ensures a stiff construction of the storage drum and a simple adjustment of the sheet-holding systems relative to one another.

Pursuant to the invention, this objective is accomplished owing to the fact that sheet-holding systems (8, 9) are provided in the front and rear regions for taking hold of the sheet (7) and can be adjusted relative to one another in the circumferential direction and the sheet holding systems (8) are assigned to the basic body (11) of the storage drum (5) for the front region and the sheet-holding systems (9) are assigned to a central axis (4), which can be fixed and rotated relative to the basic body (11) of the storage drum (5) for the rear region and the central axis (14 is connected with the sheet-holding system (9) by the side disk (17) of the basic body (11) of the storage drum (5).

8 Claims, 3 Drawing Sheets

ARRANGEMENT FOR SHEET HOLDER SYSTEMS ON STORAGE DRUMS IN TURNING DEVICES OF SHEET-FED PRINTING MACHINES

The invention relates to an arrangement of sheet-holding systems at storage drums in turning devices of sheet-fed printing machines.

Turning devices, which operate according to the three-drum turning principle, consist of three sheet-guiding cylinders, the diameter of the center one of which is twice as large.

Such a turning device enables sheets to be turned according to the rear edge principle of turning sheets and, with that, the sheets to be printed either recto or recto and verso in one pass.

The storage drum has two sheet-holding systems for the front region and two sheet-holding systems for the rear region of the sheet, which are diametrically opposite to one another. The sheet-holding systems can be adjusted relative to one another in the circumferential direction, so that sheets of different length can be processed.

From the publication DE 39 11 630 C2, an arrangement of sheet-holding systems at a storage drum is known. The sheet-holding system for the front region of the sheet, which is constructed as a clamping gripper, is disposed permanently at the body of the storage drum. The sheet holding system, which is constructed as a suction system, is provided at a supporting element, which is detachably disposed at the body of the storage drum.

The supporting element and, with that, the suction device provided at the supporting element, can be adjusted in the circumferential direction by means of an adjusting shaft, which is mounted in the drum leg. A motor for actuating the adjusting shaft is disposed over a gear wheel step at one end of the adjusting shaft (on the outside) and a pinion is disposed at the other. The pinion engages a toothed segment, which is connected with the supporting element. The adjusting shaft is mounted eccentrically in the drum shaft.

If it is necessary to adjust the sheet-holding systems relative to one another in the circumferential direction of the storage drum, the adjusting shaft, which acts over the pinion and the toothed segment on the supporting element, is rotated by means of the motor and the gear wheel step. The suction device is shifted with the supporting element relative to the clamping gripper.

The large expenditure for parts is a disadvantage of such an adjusting device of the sheet-holding systems. Many gearing elements engage one another with clearance, so that the adjustment of the sheet-holding systems with respect to the dimensions of the sheet, which is to the processed, is inaccurate. The drilling and milling in the drum shaft lead to a weakness in the drum leg.

The DE 39 008 18 C1 shows a sheet-guiding drum with an inner shaft and an outer drum with at least one segment, which can be adjusted in the circumferential direction with respect to the inner shaft. The sheet-holding systems are assigned to the inner shaft and the outer drum, which are coupled together by means of a multiple-plate clutch.

The clutch is between an end surface of the segments and a journal pin of the shaft. The clutch can be actuated over a tie rod, which can be actuated from the outside, and a clamping lever and, with that, the connection between the shaft and the segment can be undone. After that, both can be adjusted relative to one another with the sheet-holding systems.

The large expenditure for parts is a disadvantage of this fixing and loosening device. Access to the clutch within the bearing of the sheet-guiding cylinder for maintenance work in the event of wear and contamination is difficult. In this case also, the drilling and milling leads to a weakness in the leg.

It is an object of the invention to provide an arrangement of sheet-holding systems at storage drums, which ensures a stiff construction of the storage drum and a simple adjustment of the sheet-holding systems relative to one another.

Pursuant to the invention, this objective is accomplished by the distinguishing features as claimed.

Due to the arrangement of a central axis in the basic body of the storage drum, which is connected with the suction system by means of the side disks and over the cam and the cam bolt, the stiffness of the basic body of the storage drum is not reduced, since the elongated holes are disposed on the operator side of the printing machine in the storage drum, while the adjustability of the sheet-holding systems by simple means is ensured.

This mounting and arrangement of gripper system and suction system at the storage drum enables the clutch for the systems to be disposed outside of the storage drum. With that, as a result of the good accessibility, the clutch can be manipulated easily.

Figure 2:
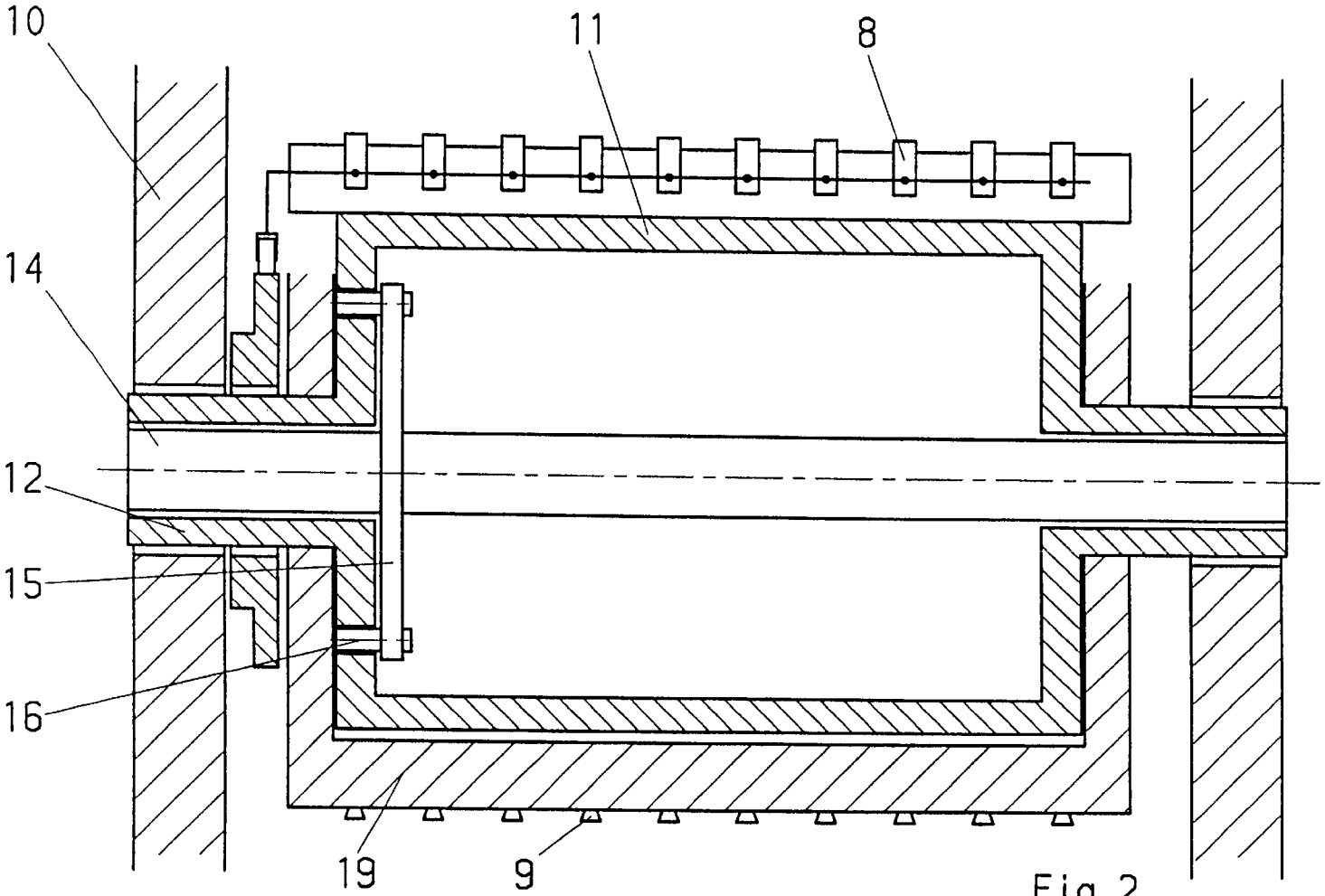
Figure 3:
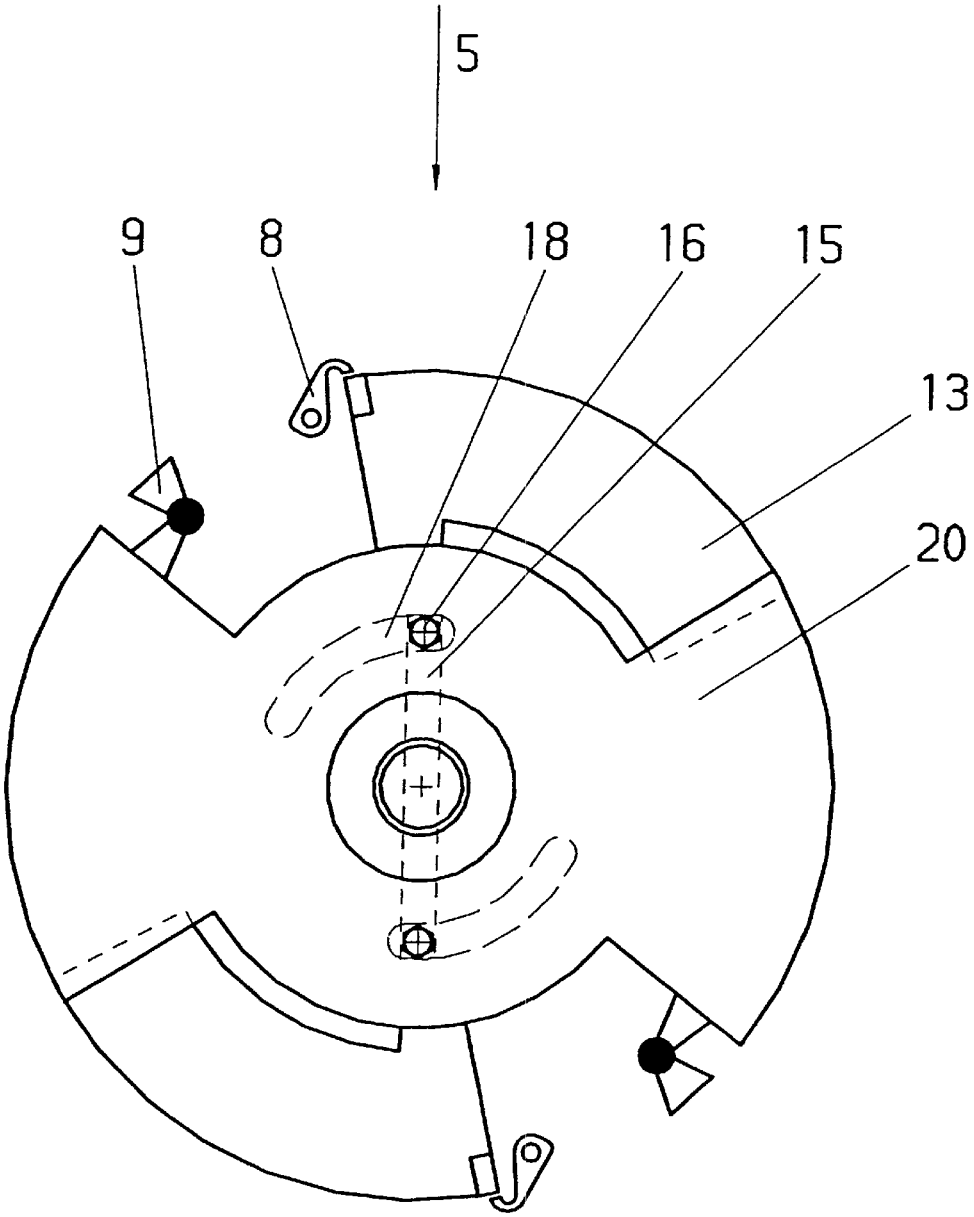

The invention is described in greater detail in the following by means of an example and associated drawings, in which FIG. 1 shows a turning device of a three-drum turning system in a diagrammatic representation in side view, FIG. 2 shows a storage drum in a detailed representation as a longitudinal section and FIG. 3 shows a side view, FIG. 1 shows a diagrammatic representation of a turning device 1 of a three-drum turning system in a printing machine and the printing cylinders 2, 2' with the rubber cylinder 3, 3', which precede and follow the turning device 1.

The turning device 1, as seen in the running direction of the sheets (marked by an arrow), consists of a transfer drum 4 of single diameter, a storage drum 5 of double diameter and a turning drum 6 of single diameter. The storage drum 5 is equipped with two sheet-holding systems 8, 9 for the sheet 7.

The sheet holding systems 8, 9 are constructed as a gripper system 8 for the front region and as a suction section system 9 for the rear region. The gripper system 8 and the suction system 9 can be adjusted relative to one another in the circumferential direction, so that sheets 7 of a maximum to a minimum format can be held in the front and rear regions on the storage drum 5. The printing cylinders 2, 2' have a double diameter. They may, of course, also have a single diameter.

The gripper systems 8 and the suction systems 9 are diametrically opposite to one another in the storage drum 5.

The detailed construction of the storage drum 5 is shown in FIG. 2.

The basic body 11 of the storage drum 5 with its tubular extension 12 is mounted rotatably in the side wall 10 of the printing machine. At the basic body 11 of the storage term 5, the gripper system 8 is assigned to the front segments 13 of the sheet. A central axis 14 is rotatably mounted in the tubular extension 12 of the basic body 11 of the storage drum 5. Within the side disks 17, a cam 15, which has a cam bolt 16 at both ends, is firmly connected with the central axis 14. Instead of the cam bolt 16, an element with a different cross section can also be connected with the cam 15.

The cam bolt 16 passes through the side disks 17 of the basic body 11 of the storage drum 5. Curved, elongated holes

18 are provided in the side disk 17 for the passage of the cam bolt 16. The length of the curved, elongated holes 18 corresponds to the necessary adjusting path (maximum to minimum format) of the storage drum 5.

The suction crosshead 19, which carries the suction system 9 and extends over the width of the storage drum 5, is assigned to the cam bolt 16. The suction crosshead is mounted on the tubular extension 12 of the basic body 11 of the storage drum 5. The rear sheet segments 20 of the sheets are firmly connected with the suction system 9.

Only one cam 15 is provided in the example. It is, however, possible to dispose a further cam 15 at the central axis 14 in the region of the other side disk 17.

The clamping device at the storage drum 5, which can be connected with or disconnected from the gripper system 8 and the suction system 9, is not shown.

For recto or recto and verso printing sheets of a different length, the sheet-holding systems 8, 9 must be adjusted relative to one another. This is done after loosening the clamping device by rotating the central axis 14 with respect to the basic body 11 of the storage drum 5. A separate motor can be disposed for this purpose on the central axis 14. In this case, the gripper system 8 is braked.

When the main driving mechanism is used for the adjustment, the central axis 14 is braked, the clamping device, which is not shown, is loosened and the basic body 11 of the storage drum 5, which is connected with the main driving mechanism, and, with that, the gripper system 8 are adjusted relative to the suction system 9.

After that, the sheet-holding systems 8, 9 once again are firmly connected with one another. The invention was described by means of a storage drum 5 in a turning device 1. It can, however, also be used at sheet-guiding cylinders in recto printing machines for guiding the sheets in the rear region.

What is claimed is:

1. A storage drum in a turning device of a sheet-fed printing machine for printing on a sheet, said storage drum comprising a basic body, a central axis having a side disk, and sheet holding systems, wherein said sheet holding systems are provided on said storage drum for taking hold of front and rear regions of said sheet and can be adjusted relative to one another in circumferential direction; wherein said sheet holding system for said front region is assigned to said basic body of said storage drum; wherein said sheet holding system for said rear region is assigned to said central axis and can be rotated relative to said basic body of said storage drum; and wherein said central axis is connected to said sheet holding system for said rear region by said side disk of said basic body of said storage drum.

2. The storage drum of claim 1, wherein said side disk has curved elongated holes.

3. The storage drum of claim 2, further comprising a cam within a cam bolt at either end of said cam, said cam bolt passing through said curved, elongated holes, and the cam is attached to said central axis.

4. The storage drum of claim 3, wherein said cam bolt is connected to a suction crosshead, which accommodates suction elements.

5. The storage drum of claim 1, wherein said sheet holding systems comprise a gripper element for holding said front region of said sheet and a suction element for holding said rear region of said sheet.

6. The storage drum of claim 1, wherein said basic body of said storage drum has a tubular extension and said central axis is mounted rotatably within said tubular extension of said basic body of said storage drum.

7. The storage drum of claim 4, wherein said basic body of said storage drum has a tubular extension and said suction crosshead is mounted on said tubular extension of said basic body of said storage drum.

8. The storage drum of claim 3, wherein said cam is located within said side disks of said storage drum.

* * * * *